US006865918B2

(12) United States Patent
Waldrop

(10) Patent No.: US 6,865,918 B2
(45) Date of Patent: Mar. 15, 2005

(54) TUBE COMPRESSING ROLLER DIE

(76) Inventor: Wesley Todd Waldrop, 222 Tiffany Trail, Anniston, AL (US) 36206

( * ) Notice: Subject to any disclaimer, the term of this patent is extended or adjusted under 35 U.S.C. 154(b) by 0 days.

(21) Appl. No.: 10/349,209

(22) Filed: Jan. 21, 2003

(65) Prior Publication Data

US 2004/0139777 A1 Jul. 22, 2004

(51) Int. Cl.[7] ..... B21B 17/14
(52) U.S. Cl. ..... 72/224; 72/370.26
(58) Field of Search ..... 72/224, 235, 367.1, 72/370.23, 370.26

(56) References Cited

U.S. PATENT DOCUMENTS

| | | | | |
|---|---|---|---|---|
| 1,645,434 A | * | 10/1927 | Lindblom | 72/224 |
| 1,890,077 A | | 12/1932 | Elting | |
| 2,059,124 A | | 10/1936 | Layton | |
| 2,207,245 A | | 7/1940 | Dvorak | |
| 3,736,846 A | | 6/1973 | Frankenberg | |
| 4,255,956 A | | 3/1981 | Zacharias | |
| 5,054,196 A | | 10/1991 | Sakaya et al. | |
| D397,601 S | | 9/1998 | Omerza | |
| D400,895 S | | 11/1998 | Schrepfer | |
| 5,907,969 A | | 6/1999 | Soder | |
| 6,397,650 B1 | * | 6/2002 | Sakurai et al. | 72/224 |

FOREIGN PATENT DOCUMENTS

| | | | | |
|---|---|---|---|---|
| JP | 06330177 A | * | 11/1994 | C21D/9/08 |
| JP | 07116708 A | * | 5/1995 | B21B/13/10 |
| JP | 07144223 A | * | 6/1995 | B21C/37/15 |
| JP | 09122748 A | * | 5/1997 | B21C/37/15 |

* cited by examiner

*Primary Examiner*—Lowell A. Larson
(74) *Attorney, Agent, or Firm*—Gene Scott, Patent Law & Venture Group

(57) ABSTRACT

A tube reduction apparatus uses a pair of plates, each of the plates providing an X-shaped aperture therein. The X-shaped aperture comprises two pairs of opposing slots, and each slot provides a pair of opposing grooves. The grooves are oriented at right angles to the slots. The pair of plates are in face to face contact with the X-shaped apertures, grooves and slots aligned. A set of four wheels are mounted on transverse axles which are captured in the grooves with the wheels positioned in the slots. A V-shaped concave annular face has an has a semi-circular annular notch at its apex. The four wheels are positioned such that their edges are in mutual adjacency forming a square passage therebetween them.

6 Claims, 4 Drawing Sheets

TUBE COMPRESSING ROLLER DIE

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to tube working dies and more particularly to a roller die for compressing or reducing the size of a square or rectangular tube and especially for compressing one end of a square tube for adapting the end for being inserted into a non-reduced tube end of the same size tubing.

2. Description of Related Art

The following art defines the present state of this field:

Omerza, U.S. Des. No. 397,601 describes a design buffer for buffing round articles.

Schrepfer, U.S. Des. No. 400,895 describes a design for a roller mill.

Elting, U.S. Pat. No. 1,890,077 describes the art of constructing sheet metal tubing comprising kneading parts of the material of a sheet to be formed into tubing while preserving the sheet in a straight condition, and then shaping the sheet into tubing.

Layton, U.S. Pat. No. 2,059,124 describes a combination of a forging die having a billet-receiving opening of predetermined cross-sectional dimensions, a preshaping device adapted to receive a billet of greater diagonal dimensions cross-sectionally of the billet than the largest cross-sectional measurement of the die opening and comprising means arranged to engage the diagonal corners solely of said billet to press said corners radially toward the longitudinal axis of the billet simultaneously and simultaneously bulging the billet radially between said corners to measurements less than said dimensions of the die opening, and means for passing a billet through said device to preshape the billet preparatory to its entrance into the die.

Dvorak, U.S. Pat. No. 2,207,245 describes a method of drawing tubes from hollow blanks fitted on a mandrel comprising drawing longitudinal grooves in sections distributed on the outside of the work, drawing the work through a caliber formed by freely rotatable drawing rollers arranged in such manner that the edges of their operative surfaces meet over the longitudinal grooves previously formed in the work, drawing the work through freely rotatable pressure rollers arranged around the work in angular displacement with reference to the said drawing rollers in order to slightly enlarge the diameter of the work and to thus separate the inside wall of the work from the mandrel, the foregoing operations being performed at the first work station, and repeating said, operations at successive work stations spaced apart a distance at least greater than the length of the work on the mandrel after having passed through the preceding work station.

Frankenberg, U.S. Pat. No. 3,736,846 describes a container body maker including means for forming a completed cylindrical container body and a means for reshaping the cylindrical container body. The reshaping means includes angularly spaced posts arranged to support the cylindrical container and bending means disposed between the posts. The bending means serve to depress the portions of the cylindrical body spanning the posts to reshape the body.

Zacharias, U.S. Pat. No. 4,255,956 describes an apparatus for sizing square metal ingots to be subsequently pierced in a push bench to form pierced blanks for rolling into tubes having freely rotatable sizing rolls to engage the corner edges of the ingot as the ingot is pushed through the support and freely rotatable guiding rollers to engage the side faces of the ingot. The sizing rolls are radially adjustable by means of both a coarse adjustment device and a fine adjustment device while the guiding rollers are only provided with coarse adjustment.

The adjustment devices can be computer controlled so that both ends of the ingot are conically tipped and so that the ingot is slightly tapered throughout its length.

Sakaya, et al, U.S. Pat. No. 5,054,196 describes a wick layer that is attached and fixed to one surface of a metal tape without forming a gap with the metal surface, and thereafter, the tape is rolled so that the surface having the wick layer serves as an inner surface, thus forming a pipe shape, then the pipe wall is corrugated. According to the above process, the wick layer is completely and uniformly attached to the inner surface of the heat pipe.

Soder, U.S. Pat. No. 5,907,969 describes a tool for working a shaped metal tube, such as a square or rectangular metal tube, having a hollow interior and an outer surface to produce an end reduction in the tube. The tool includes a head having a longitudinally extending interior cavity and a plurality of roller cavities, each communicating with the interior cavity. A plurality of grooved rollers are rotatably mounted within the head, one within each of the roller cavities. Each of the grooved rollers has a periphery extending into the interior cavity and configured to engage a portion of the outer surface of the tube to be reduced, such as a corner portion of a square tube. Depending upon the shape of the tube being reduced, the tool may further include a pair of flat-area rollers. The flat-area rollers may be used to engage the relatively long sides of a rectangular tube. The tool further includes a mandrel disposed within the interior cavity of the head and spaced apart from the periphery of each of the rollers, with the mandrel being effective for preventing the tube from collapsing as a result of the end reduction. The tool may also include a rake which is effective for maintaining the shape of the end of the tube being reduced.

The prior art teaches apparatus for reducing the diagonal dimensions of a rectangular billet, rolling mills with diametrically opposed rollers for reshaping the corners of a tube or billet, a method for depressing portions of a cylindrical tube, a machine adapted for forming a groove along the length of a pipe, and designs for rolling mills and buffing machines, but does not teach a simplified apparatus and method for reducing the size of an end of a sheet metal tube. The present invention fulfills these needs and provides further related advantages as described in the following summary.

SUMMARY OF THE INVENTION

The present invention teaches certain benefits in construction and use which give rise to the objectives described below.

A tube reduction die uses a pair of plates, each of the plates providing an X-shaped aperture therein. The X-shaped aperture comprises two pairs of opposing slots, and each slot provides a pair of opposing grooves. The grooves are oriented at right angles to the slots. The pair of plates are in face to face contact with the X-shaped apertures, grooves and slots aligned. A set of four wheels are mounted on transverse axles which are captured in the grooves with the wheels positioned in the slots and rotating on bearings. A V-shaped concave annular face has a semi-circular annular notch at its apex. The four wheels are positioned such that their edges are in mutual adjacency forming a square passage between them. A tube is forced into the square passage and is uniformly reduced in size while maintaining its square shape and without excessive sidewall deformation.

A primary objective of the present invention is to provide an apparatus and method of use of such apparatus that provides advantages not taught by the prior art.

Another objective is to provide such an invention capable of reducing a square or rectangular sheet metal tube in size at one of its ends.

A further objective is to provide such an invention capable of reducing the tube in size while maintaining its square shape.

A still further objective is to provide such an invention capable of reducing the tube in size without causing excessive side wall deformation.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
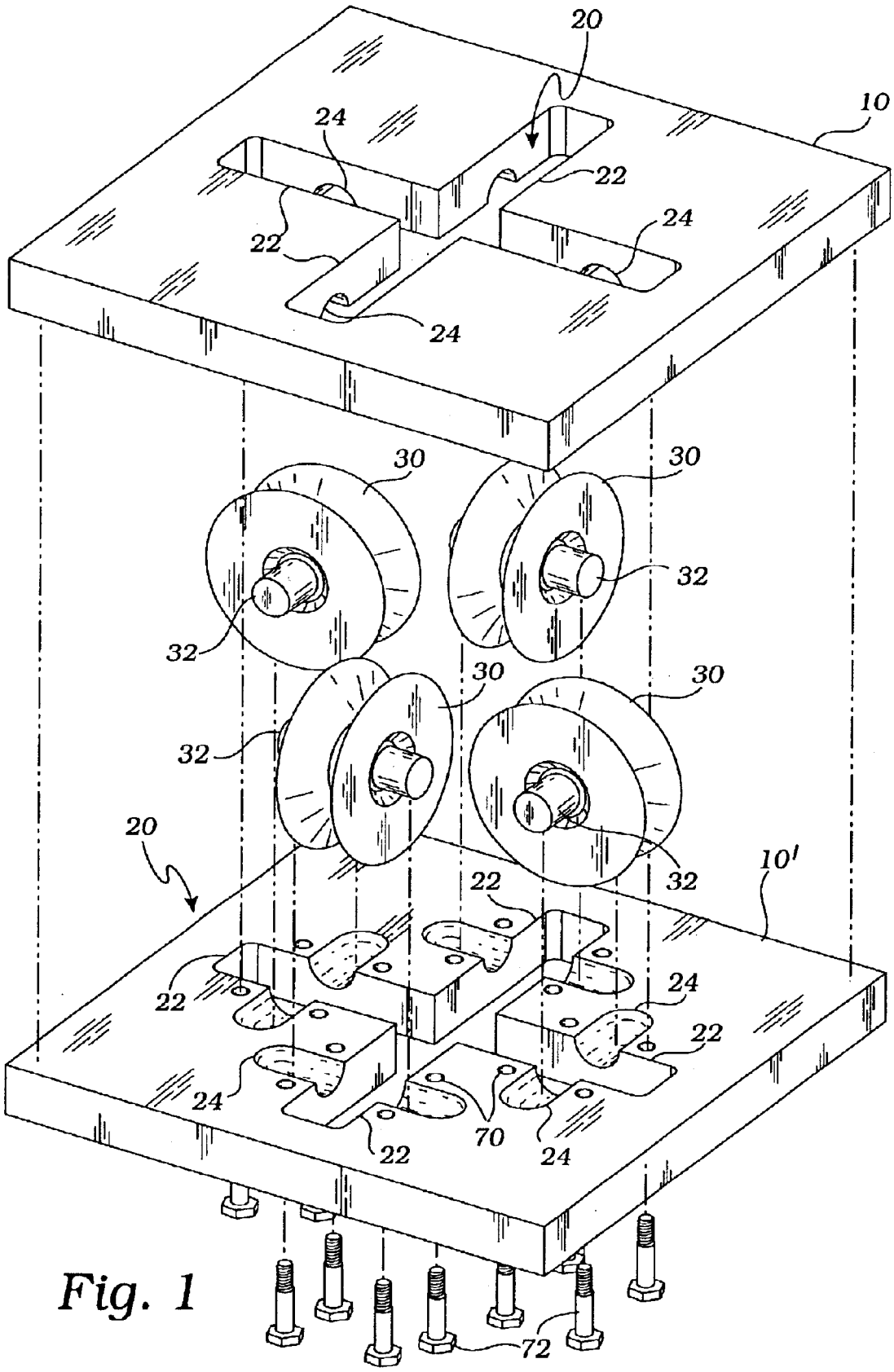
FIG. 1 is a perspective exploded view of the preferred embodiment of the invention.
Figure 2:
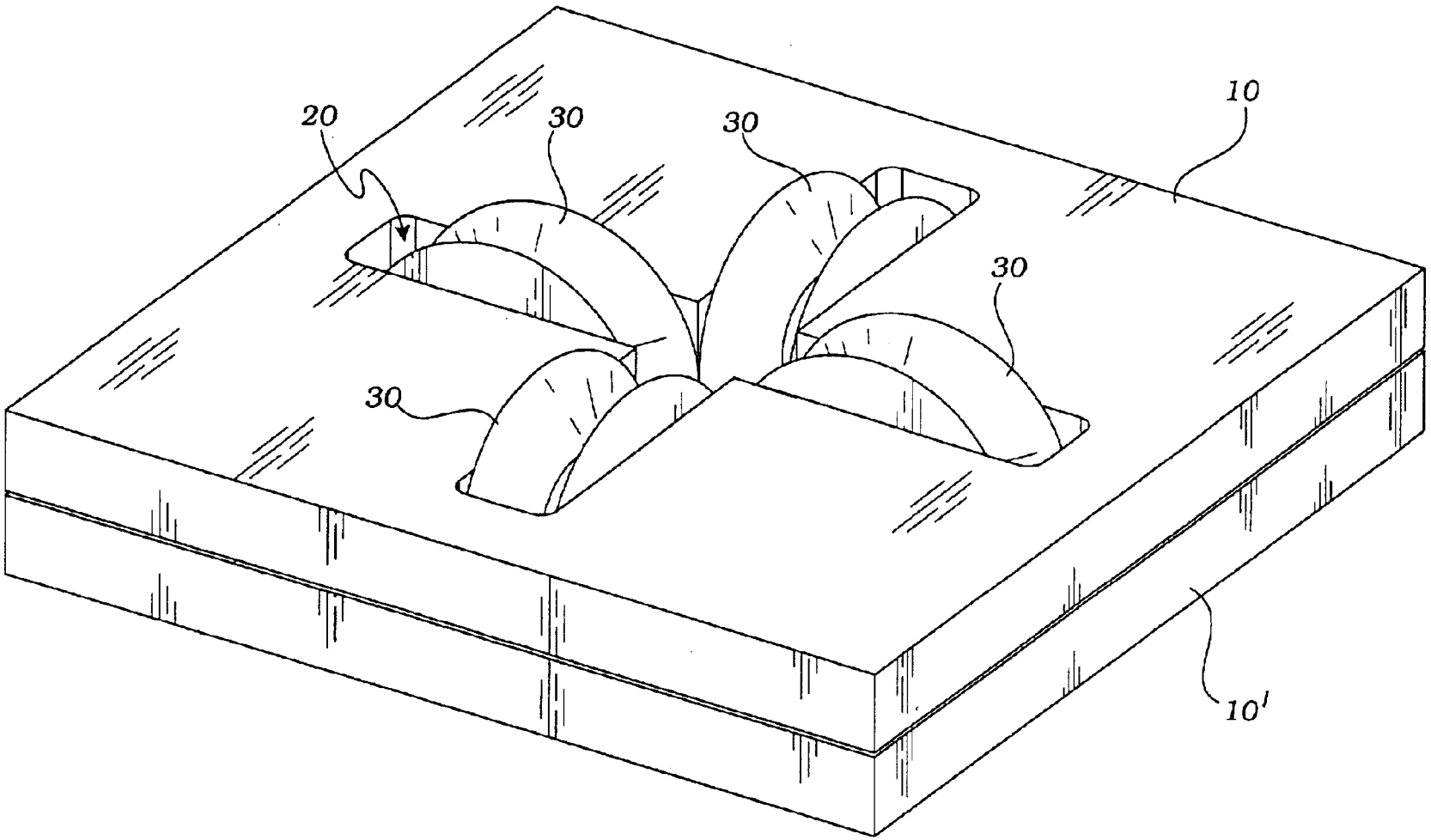
FIG. 2 is a perspective view thereof as assembled for operation.
Figure 3:
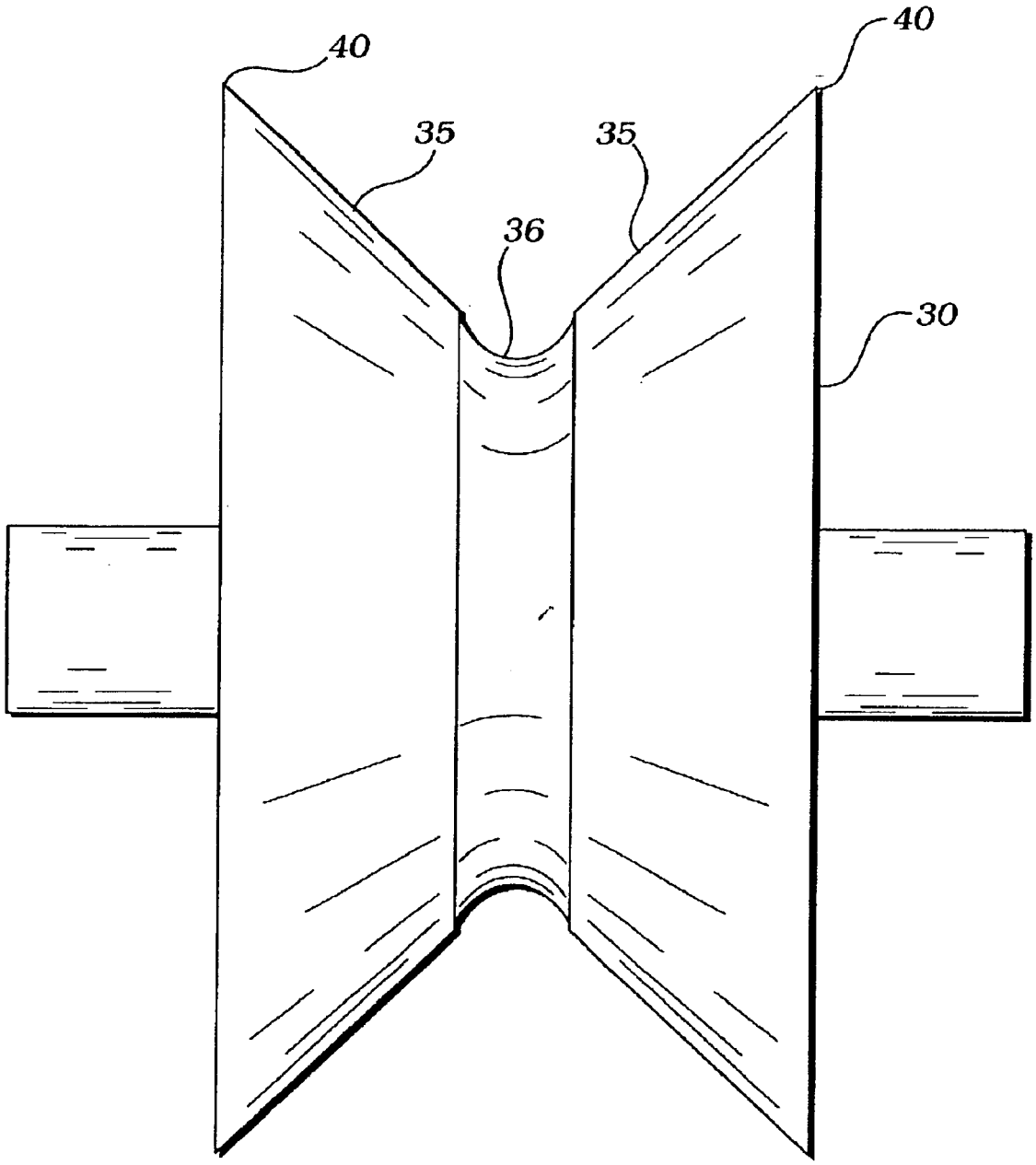
FIG. 3 is a side elevational view of a wheel thereof.
Figure 4:
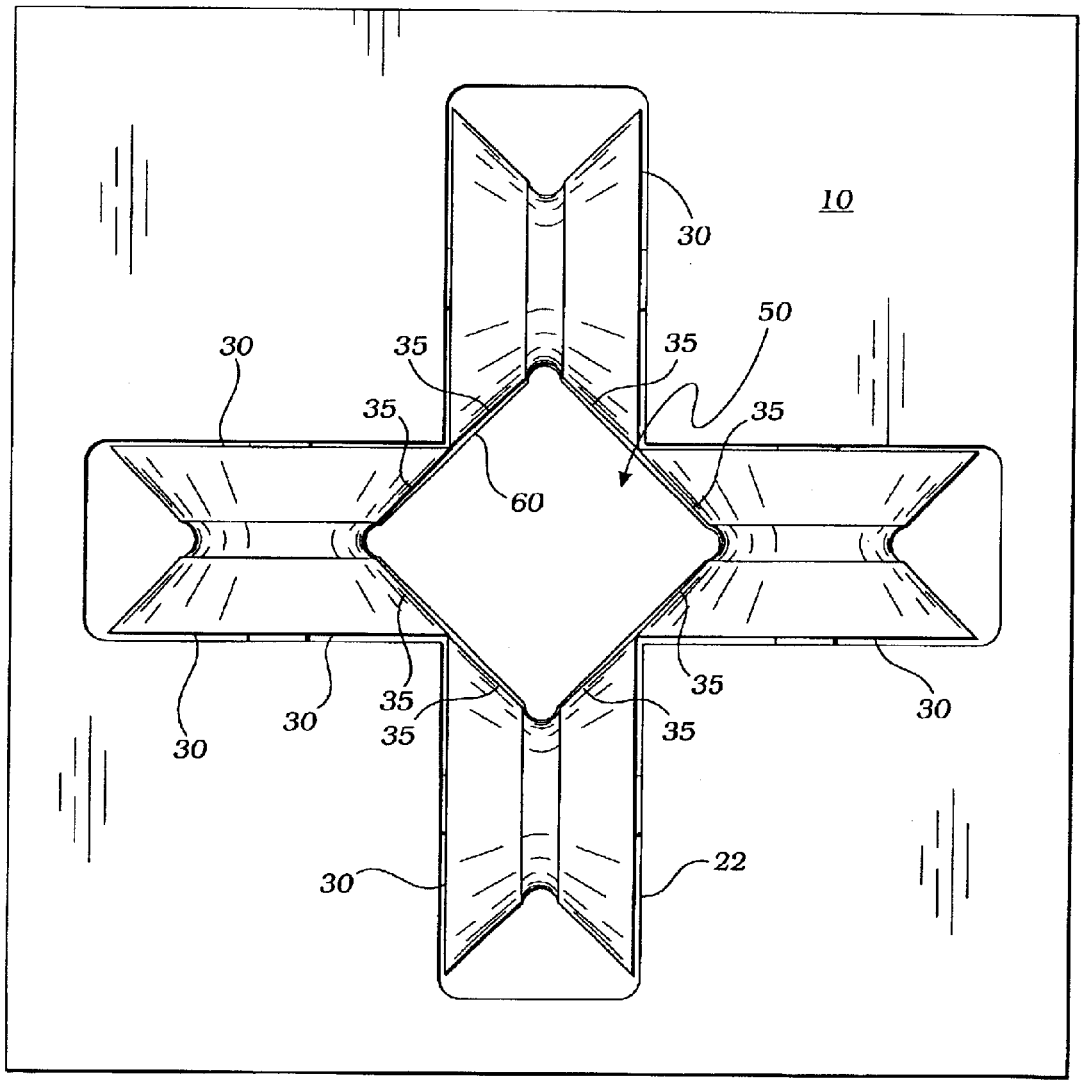
FIG. 4 is a plan view thereof including a tube shown in the process of being reduced within the invention apparatus.

The present invention is a tube reduction apparatus. A pair of plates 10, 10' are preferably made of steel or similar structural material and are both pierced with an X-shaped aperture 20 as shown in FIGS. 1 and 2. The X-shaped apertures 20 each comprise two pairs of opposing slots 22, with each of the slots 22 providing a pair of opposing grooves 24 oriented at right angles to the slots 22. This is clearly shown in the lower plate of FIG. 1. The pair of plates 10, 10' are in face-to-face contact with the X-shaped apertures 20, the opposing slots 22 and the grooves 24 aligned and the grooves 24 abutting, as shown in FIG. 1. A set of four wheels 30 each mounted on a transverse axles 32. An annular face 34 of each of the wheels 30 provides a concave V-shape. An apex 36 of the annular face 34 provides a semi-circular annular notch. It is noted that within each of the wheels 30, surfaces 35 of the V-shaped face 34 are at right angles to each other. This is best seen in FIGS. 3 and 4. The transverse axles 32 of each one of the four wheels 30 are engaged within one of the opposing grooves 24 of one of the slots 22 thereby placing outer edges 40 of the four wheels 30 in mutual adjacency forming a square passage 50 therebetween as can be seen best in FIG. 4. In the preferred embodiment, shown in FIG. 1, the plates 10 and 10' are made with clearance holes 70 in plate 10' and corresponding blind threaded holes (not shown) in plate 10. Bolts 72 are used to secure the two plates together with wheels 30 mounted within grooves 24. In an alternate embodiment, a single plate such as plate 10 may be used without plate 10'. In this case, the wheels 30 are secured to the plate 10 by individual blocks that are fastened over the axles of the wheels to secure them in place. Each one of such blocks are made to provide the groove 24 that clamps about the axle of wheel 30 on each side.

In operation, a tube 60 that is somewhat larger than the square passage 50 is pressed into, and/or drawn into the passage 50, and as it moves into the passage 50 it is pressed inwardly on all sides by the surfaces 35 of the V-shaped faces 34. Because of the semi-circular apex notch 36 on each of the wheels 30, the walls of the tube 60 tends to wrinkle and fold in locations that are toward the corners of the tube and in fact strengthen the corners considerably, thereby reducing the size of the tube in a predictable manner and maintaining the tube's square or rectangular shape.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A tube reduction apparatus comprising: a pair of abutting plates, each of the plates providing an X-shaped aperture therein, the X-shaped aperture comprising two pairs of opposing slots, each said slot providing a pair of opposing grooves oriented at right angles to the slot; the pair of plates in face to face contact with the X-shaped apertures and the grooves and slots aligned; a set of four wheels, each of the wheels mounted on a transverse axle and providing a V-shaped concave annular face with the apex of the V-shaped face formed as a circular portion annular notch, the circular portion annular notch radially displaced inwardly so that ends of the notch do not smoothly join the V-shaped face; the transverse axles of each one of the four wheels rotationally engaged within one of the opposing grooves of one of the slots thereby placing outer edges of the four wheels in mutual adjacency forming an approximately square passage.

2. A tube reduction apparatus comprising: a set of four wheels rotationally mounted in a pair of abutting plates, the wheels positioned in opposing locations; each of the four wheels providing a V-shaped concave annular face having a circular portion annular notch radially displaced inwardly so that ends of the notch do not smoothly join the V-shaped face; outer edges of the four wheels in mutual adjacency forming an approximately square passage.

3. The apparatus of claim 2 wherein each of the four wheels provides a transverse axle.

4. The apparatus of claim 3 wherein each of the transverse axles is positioned within a pair of opposing grooves in both of the pair of abutting plates.

5. The apparatus of claim 4 wherein each of the opposing grooves is formed at right angles with respect to a slot, each one of the wheels rotating within one of the slots.

6. The apparatus of claim 2 wherein the V-shaped concave annular face of each of the wheels terminates with a semi-circular annular notch.

* * * * *